United States Patent [19]

Sauer

[11] Patent Number: 4,497,443

[45] Date of Patent: Feb. 5, 1985

[54] INJECTION VALVE

[75] Inventor: Rudolf Sauer, Benningen, Fed. Rep. of Germany

[73] Assignee: Robert Bosch GmbH, Stuttgart, Fed. Rep. of Germany

[21] Appl. No.: 415,214

[22] Filed: Sep. 7, 1982

[30] Foreign Application Priority Data

Dec. 23, 1981 [DE] Fed. Rep. of Germany ..... 3151020

[51] Int. Cl.[3] ..... B05B 1/02; B05B 1/26; F02M 69/04; F02M 61/16

[52] U.S. Cl. ..... 239/533.3; 239/488; 239/533.12

[58] Field of Search ..... 239/585, 552, 533.2–533.12, 239/590, 520, 453, 488, 489

[56] References Cited

U.S. PATENT DOCUMENTS 1,876,980 9/1932 Lentell, Jr. ..... 239/533.12
2,088,007 7/1937 Zumbusch ..... 239/533.12
3,628,734 12/1971 Lindell et al. ..... 239/488 X
4,421,278 12/1983 Kienzle et al. ..... 239/533.12

FOREIGN PATENT DOCUMENTS 3023757 1/1982 Fed. Rep. of Germany ..... 239/533.12

*Primary Examiner*—Andres Kashnikow
*Attorney, Agent, or Firm*—Edwin E. Greigg

[57] ABSTRACT

An injection valve for fuel injection systems in internal combustion engines is proposed, which serves to supply fuel into the intake tube of the engine. The injection valve includes a movable valve element, which cooperates with a fixed valve seat, downstream of which a guide bore is provided in a nozzle body. An insert is pressed into this guide bore. The insert has grooves which extend in an axial direction and serve the purpose of metering the fuel to be injected. The grooves may be embodied by faces, which can be reground in a simple manner in order to correct the injection quantity.

5 Claims, 5 Drawing Figures

INJECTION VALVE

BACKGROUND OF THE INVENTION

The invention is based on an injection valve for fuel injection system of internal combustion engines, comprising a movable valve element arranged to cooperate with a fixed valve seat provided in a nozzle body. It has already been proposed to provide an insert in an injection valve downstream of the valve seat, the insert being pressed with a milled tang into a guide bore; adjacent thereto, the insert has a metering section which has a cylindrical configuration. An embodiment of this kind requires additional expenditure for producing the milled tang and for precise machining of the metering section.

OBJECT AND SUMMARY OF THE INVENTION

The injection valve according to the invention as revealed hereinafter has the advantage over the prior art that the insert intended for metering and fuel preparation purposes can be fabricated in an uncomplicated manner; the invention enables simple and precise machining of the insert in order to attain the desired metering cross sections.

By means of the characteristics disclosed herein, advantageous further developments of and improvements to the injection valve disclosed in this application are possible. It is particularly avantageous to provide grooves extending in the axial direction on the insert for metering purposes, the grooves being formed at one end by faces formed on the insert.

It is also advantageous to incline the faces relative to the axis of the insert in such a manner that the distance between the axis and each face is smaller at the end oriented toward the valve seat than at the end remote from the valve seat; thus the metering quantity can be corrected by means of displacing the insert.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
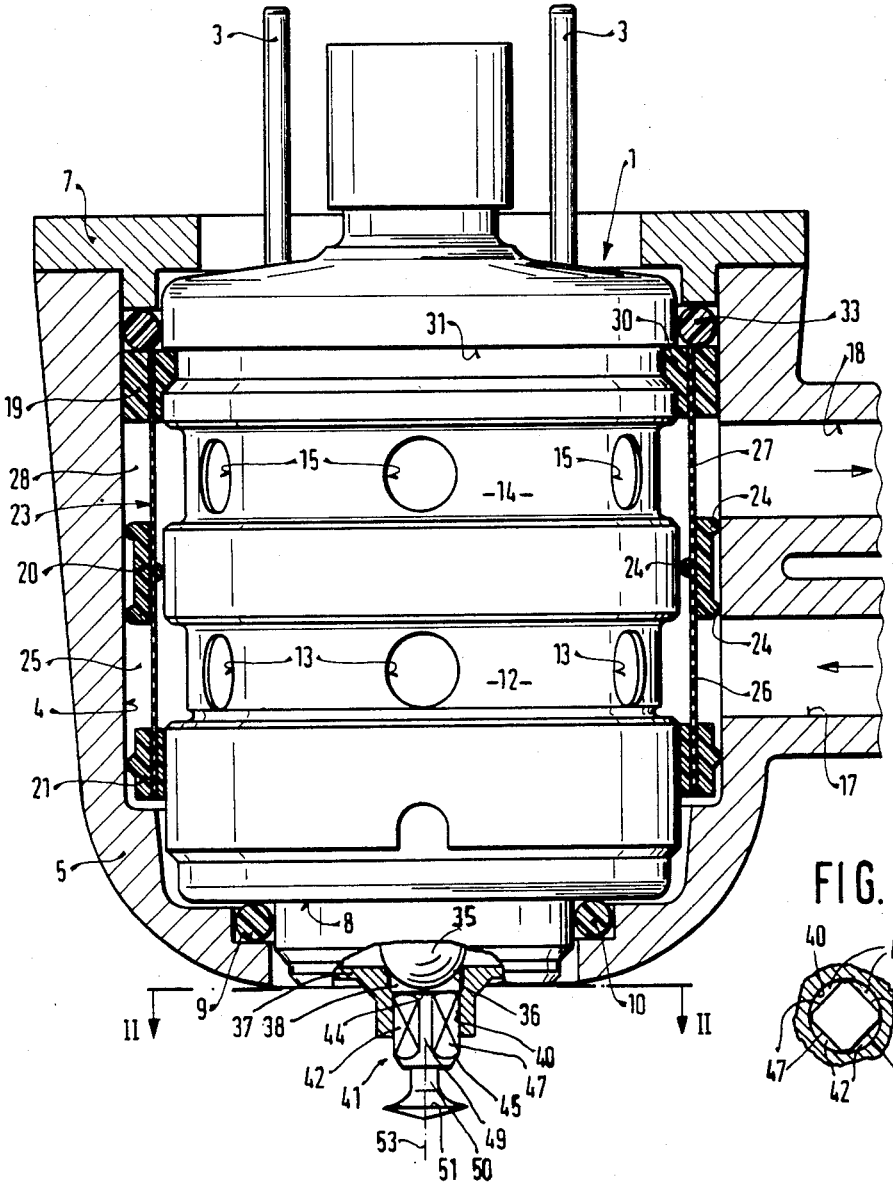
FIG. 1 shows a cross sectional view of an injection valve having an insert according to the invention for metering fuel quantity and for fuel preparation.

The fuel injection valve shown by way of example in FIG. 1 is electromagnetically actuatable in a known manner and serves by way of example as part of a fuel injection system for the injection of fuel, especially at low pressure, into the air intake tube of mixture-compressing internal combustion engines having externally supplied ignition. The electrical triggering of the fuel injection valve 1 may take place in a known manner via contact pins 3. The fuel injection valve 1 is supported in a guide opening 4 of a holder body 5 and may be fixable in the axial direction, for example, by a claw means or a cap 7; a sealing ring 10 rests against one end face 8 of the fuel injection valve 1, remote from the cap 7, and is supported at the other end on a step 9 of the holder body 5. The holder body 5 may either be embodied by the wall of the air intake tube itself, or it may be embodied as a separate part. The fuel injection valve 1 has an annular fuel supply groove 12, from whence fuel supply openings 13 lead into the interior of the fuel injection valve 1. The fuel injection valve 1 also has an annular fuel discharge groove 14, which is axially offset from the fuel supply groove 12 and shown opposite it in the drawing; fuel discharge openings 15 lead from this discharge groove 14 into the interior of the fuel injection valve 1. A fuel supply line 17 discharges into the fuel supply groove 12 and communicates in a manner not shown with a fuel supply source, for example a fuel pump. The fuel flowing via the fuel supply tem for the injection of fuel, especially at low pressure, into the air intake tube of mixture-compressing internal combustion engines having externally supplied ignition. The electrical triggering of the fuel injection valve 1 may take place in a known manner via contact pins 3. The fuel injection valve 1 is supported in a guide opening 4 of a holder body 5 and may be fixable in the axial direction, for example, by a claw meansor a cap 7; a sealing ring 10 rests against one end face 8 of the fuel injection valve 1, remote from the cap 7, and is supported at the other end on a step 9 of the holder body 5. The holder body 5 may either be embodied by the wall of the air intake tube itself, or it may be embodied as a separate part. The fuel injection valve 1 has an annular fuel supply groove 12, from whence fuel supply openings 13 lead into the interior of the fuel injection valve 1. The fuel injection valve 1 also has an annular fuel discharge groove 14, which is axially offset from the fuel supply groove 12 and shown opposite it in the drawing; fuel discharge openings 15 lead from this discharge groove 14 into the interior of the fuel injection valve 1. A fuel supply line 17 discharges into the fuel supply groove 12 and communicates in a manner not shown with a fuel supply source, for example a fuel pump. The fuel flowing via the fuel supply line 17 into the fuel supply groove 12 passes through the fuel supply openings 13 into the interior of the fuel injection valve 1 and is either ejected into the air intake tube or else flows through the fuel injection valve in order to absorb heat therefrom, then passing via the fuel discharge openings 15 into the fuel discharge groove 14, which communicates with a fuel dishcarge line 18 embodied in the holder body 5.

The fuel injection valve 1 is radially guided within the guide opening 4 of the holder body 5 by means of elastic support bodies 19, 20, 21 of a fuel filter 23, which extends in the axial direction and overlaps the fuel supply groove 12 and the fuel discharge groove 14. The support bodies 19, 20, 21 are fabricated from some elastic material, for instance rubber or plastic. The middle support body 20 in particular is annular and is embodied such that, being provided with sealing protrusions 24 for example, it is supported on the circumference of the fuel injection valve 1 between the fuel supply groove 12 and the fuel discharge groove 14 on the one hand and on the guide opening 4 on the other so as to seal off the fuel supply groove 12 and the fuel supply line 17 with respect to the fuel discharge groove 14 and the fuel discharge line 18. The fuel flowing by way of the fuel supply line 17 first reaches an annular groove 25 formed between the middle support body 20 and the lower end support body 21 of the fuel filter, and from this annular groove 25 the fuel can flow through the filter zone 26 into the fuel supply groove 12. From the fuel discharge groove 14, the fuel can flow through the filter zone 27 into an annular groove 28 formed between the upper end support body 19 and the middle support body 20 of the fuel filter 23; this annular groove 28 communicates with the fuel discharge line 18. Contaminant particles contained in the fuel are filtered out by the filter zones 26, 27. Particularly because of the elastic composition of the middle support body 20, it is possible to attain simple machining and greater tolerances in the circumference of the fuel injection valve 1 and in the diameter of the guide opening 4. The upper support body 19 may be provided on its end oriented toward the fuel injection valve 1 with a detent protrusion 30, which when the fuel filter 23 is pushed onto the fuel injection valve comes into engagement with a detent groove 31 of the fuel injection valve, so that the fuel injection valve 1 can be inserted, together with the fuel filter 23 mounted on it, into the guide opening 4 of the holder body 5. A sealing ring 33 may likewise be supported axially on the upper support body 19, being disposed between the fuel injection valve 1 and the holder body 5 and fixed at the other end by the cap 7.

The fuel injection valve 1 has a moveable valve element 35, which is spherical by way of example and which cooperates with a correspondingly shaped valve seat 36 in a nozzle body 37. When the electromagnet of the fuel injection valve is excited, the moveable valve element 35 is lifted from the valve seat, so that fuel can flow between the movable valve element 35 and the valve seat 36 and on into a collecting chamber 38 having the least possible volume. Adjoining the collecting chamber 38 is a guide bore 40 likewise embodied on the nozzle body 37. An insert 41 is inserted partway into the guide bore 40 and has grooves 42 (see FIG. 2) which open in the direction of its circumference. On the other end, the grooves 42 are partially closed by the wall of the guide bore 40. The grooves 42 extend in the axial direction from one end 44 in the collecting chamber 38 to the other end of the insert 41.

Figure 2:
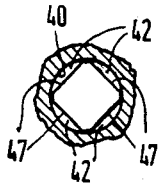
FIG. 2 is a section taken along the line II—II of FIG. 1.

In the exemplary embodiment of the insert 41 shown in FIGS. 1 and 2, the grooves 42 are created in such a manner that the faces 47 which extend in the axial direction on the insert 41 are machined, for instance by grinding. Thus the insert 41 may be made of some round material or rod-like stock, in such a manner that if four faces 47 are ground, for example, then a square such as that shown in FIG. 2 is created. The faces 47 may be ground very precisely, so that very precise grooves 42 are formed between the faces 47 and the wall of the guide bore 40, the grooves acting in a throttling manner to effect fuel metering and preparation. The faces 47 may be reground as needed after the mounting of the injection valve 1, so that a correction in order to attain the desired metering quantity can be made easily. The section 49 of the insert 41, which has the faces 47 serving the purpose of fuel metering, can be adjoined via a connecting section 50 by a section 51 which shapes the injection stream. As a rule, this section 51 has a larger diameter than does section 49 and serves to divert the fuel flowing by way of the grooves 42. The shaping section 51 serves as a spin plate and may be embodied in conical fashion, with a diameter which increases in the direction of fuel flow; the cone of the fuel injection stream depends on the shape of the conical course of this section 51. The shaping section 51 assures very good preparation of the injected fuel.

Figure 3:
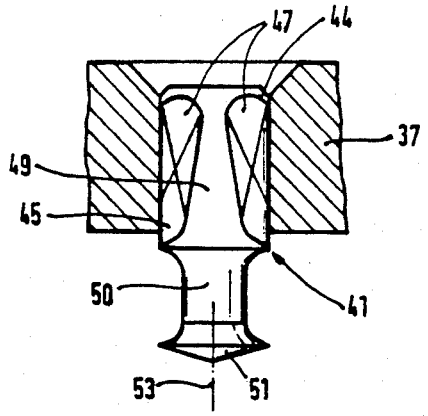
FIG. 3 is a fragmentary detailed view of a second exemplary embodiment of an insert.

While the faces 47 of the insert 41 in the exemplary embodiment of FIG. 1 extend in a plane which is parallel to the axis 53 of the insert 41, the faces 47 in the exemplary embodiment of FIG. 3 are tilted relative to the axis 53 such that the distance between the axis 53 and the plane extending through the faces 47 is less at the end 44 oriented toward the valve seat 36 than at the remote end 45. Since the metering depends on the throttling effect of the grooves 42, it is possible in the embodiment of FIG. 1 as well to attain a certain variation of the metering quantity for corrective purposes by pushing the section 49 into the guide bore 40 to a greater or lesser depth; however, this adjustability is limited in the embodiment of FIG. 1. In contrast to this, the displacement of the insert 41 in the embodiment of FIG. 3 permits the attainment of a substantially greater variation in the throttling effect of the grooves 42 and thus in the metering quantity as well.

As in the foregoing embodiment, four faces 47, or more or fewer, may be embodied on the section 49 of the insert 41. In the insert 41 of FIG. 3 as well as in the subsequent exemplary embodiments of an insert, a shaping section 51 may be advantageous for the sake of better fuel preparation and better shaping of the stream of injected fuel.

Figure 4:
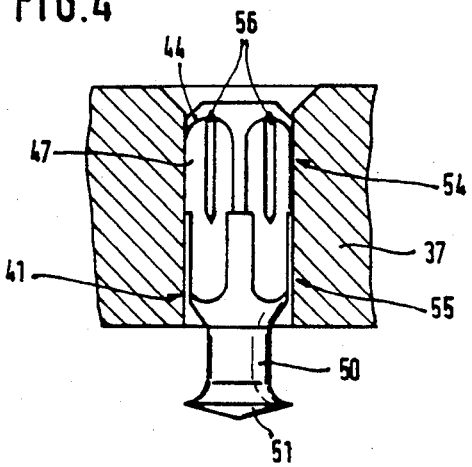
FIG. 4 is another fragmentary detailed view of a third exemplary embodiment of an insert.

The exemplary embodiment of an insert 41 shown in FIG. 4 has a supply section 54 on the end 44 oriented toward the valve seat; the supply section 54 is adjoined in the direction away from the valve seat by a metering section 55. The faces 47 extend over both the supply section 54 and the metering section 55. Over the length of the supply section 54, supply grooves 56 open toward the faces 47 are additionally machined into the faces 47, enabling a larger flow cross section in this vicinity, so that the outer diameter can be reduced in the metering section 55, for instance by lapping, and adjusting the static, flowing fuel quantity can therefore be accomplished quite precisely.

Figure 5:
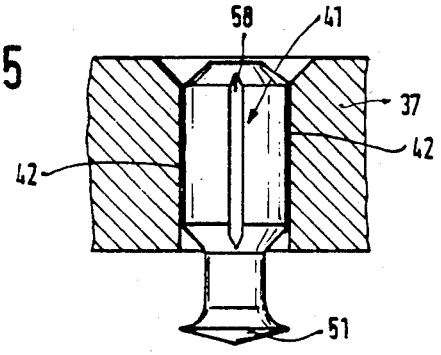
FIG. 5 is still another fragmentary detailed view of a fourth exemplary embodiment of an insert.

In the exemplary embodiment of FIG. 5, the grooves which are open toward the circumference of the insert 41 are embodied for metering purposes as longitudinal slits 58 (preferably three or more longitudinal slits 58 being provided), and the slits are formed by erosion. It is thus likewise possible to adjust the static injection quantity very precisely, merely by regrinding only one of the longitudinal slits 58.

It is likewise possible to combine the embodiments of FIGS 1–5; that is, for metering purposes, longitudinal slits 58 can be provided in addition to the faces 47. The longitudinal slits 58 may then be located in the faces 47 or at some other point on the circumference of the insert 41.

The insert 41 may be fixed in the axial direction by spot-welding, for instance, using a laser beam. In this connection, since the spot-welding assembly of the insert 41 with the bore 40 is to be done by an expert technician, it is contemplated that the wall of the insert can be provided with guide markings so that the insert can be positioned into the bore 40 a predetermined distance in order to furnish the correct injection quantity.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. An injection valve for fuel injection systems of internal combustion engines, comprising a movable valve element arranged to cooperate with a fixed valve seat provided in a nozzle body, characterized in that said nozzle body has a guide bore downstream of said valve seat, a fuel flow control insert in said bore, said fuel flow control insert in said bore having a linear axis, said fuel flow control insert having axially extending grooves open toward said guide bore, said axially extending grooves further including a plurality of axially extending faces tilted relative to said linear axis of said insert whereby the distance between said linear axis and each said face is smaller at an end oriented toward said valve seat than at an end remote therefrom thereby forming a flow cross section which decreases in the direction of fluid flow, and said grooves are arranged to meter and prepare a fluid to be injected.

2. An injection valve as defined by claim 1, characterized in that said insert is introduced into said guide bore a controlled distance to fix the desired fuel quantity to be metered.

3. An injection valve as defined by claim 1, characterized in that said insert has four faces.

4. An injection valve as defined by claim 1, characterized in that said insert further includes a section remote from said valve seat which shapes the fuel flow stream and further has a larger diameter than said guide bore.

5. An injection valve for fuel injection systems of internal combustion engines, comprising a movable valve element arranged to cooperate with a fixed valve seat provided in a nozzle body, characterized in that said nozzle body has a guide bore downstream of said valve seat, a fuel flow control insert in said bore, said fuel flow control insert in said bore further includes a supply section oriented toward said valve seat and a metering section remote from said valve seat, said fuel flow control insert having axially extending grooves open toward said guide bore, said axially extending grooves further including a plurality of axially extending faces wherein said supply section is provided with machined supply grooves which open toward said faces, and further that said metering section has a smaller diameter, adapted to the quantity of fluid to be metered, than said supply section, and said axially extending grooves are arranged to meter and prepare a fluid to be injected.

* * * * *